US006530820B1

(12) United States Patent
Katze et al.

(10) Patent No.: US 6,530,820 B1
(45) Date of Patent: Mar. 11, 2003

(54) GARMENT WITH INTEGRAL BRASSIERE

(75) Inventors: Enid Gilbert Katze, Tenafly, NJ (US); Lynn Ruth O'Donnell, New York, NY (US); Stephanie Ann Meehan, Denville, NJ (US)

(73) Assignee: O'Bryan Brothers, Inc., Chicago, IL (US)

( * ) Notice: Subject to any disclaimer, the term of this patent is extended or adjusted under 35 U.S.C. 154(b) by 0 days.

(21) Appl. No.: 10/035,974

(22) Filed: Oct. 23, 2001

(51) Int. Cl.[7] ..... A41C 3/00
(52) U.S. Cl. ..... 450/7; 450/30
(58) Field of Search ..... 450/1, 7, 10, 11, 450/12, 15, 16, 30, 31, 33, 41, 45, 46, 49, 51, 60, 62, 64, 70; 2/69, 78.1, 113, 115, 106, 243.1, 67

(56) References Cited

U.S. PATENT DOCUMENTS

| | | | | | |
|---|---|---|---|---|---|
| 1,994,990 | A | * | 3/1935 | Flesh | 2/67 |
| 2,438,062 | A | * | 3/1948 | Licht | 450/32 |
| 4,372,320 | A | | 2/1983 | Silber | |
| 4,398,538 | A | * | 8/1983 | Johnson | 2/67 X |
| 4,440,174 | A | | 4/1984 | Cordova | |
| 4,564,015 | A | | 1/1986 | Friedman | |
| 4,590,945 | A | | 5/1986 | Fiel | |
| 4,798,557 | A | | 1/1989 | Scott | |
| 4,866,791 | A | | 9/1989 | Carver et al. | |
| 4,956,878 | A | * | 9/1990 | Boynton | 2/67 |
| 5,033,986 | A | | 7/1991 | Feigenbaum et al. | |
| 5,045,018 | A | | 9/1991 | Costanzo | |
| 5,478,278 | A | * | 12/1995 | Greenblatt | 450/32 |
| 5,678,246 | A | | 10/1997 | Cooley et al. | |
| 6,059,633 | A | | 5/2000 | Currier | |
| 6,113,460 | A | | 9/2000 | McKeown | |
| 6,336,840 | B2 | * | 1/2002 | Heroff | 450/30 |
| 6,443,805 | B1 | * | 9/2002 | Kirkwood | 450/31 |

* cited by examiner

*Primary Examiner*—Gloria M. Hale
(74) *Attorney, Agent, or Firm*—Wood, Herron & Evans, LLP

(57) ABSTRACT

A woman's garment (10) includes a tubular garment body (20) and an inner support unit (50). The preferred inner support unit (50) comprises a liner (52) secured to the garment body (20) along an upper edge portion (30) of the garment body (20); a pair of underwire members (54, 56) secured to the liner (52) proximate a lower edge portion (60); and an elastic member (58) extending along the lower edge portion (60) of the liner (52). The liner (52) preferably includes darts (104, 106) formed in support sections (100, 102) of the liner (52) defined by the underwire members (54, 56), forming a slight degree of concavity in the support sections (100, 102). The preferred liner (52) and elastic member (58) are capable of encircling the wearer's torso (23) to provide a comfortable fit and support without detachable fasteners (not shown) which complicate the garment and show through to the exterior creating unsightly bulges.

22 Claims, 5 Drawing Sheets

GARMENT WITH INTEGRAL BRASSIERE

FIELD OF THE INVENTION

The present invention relates generally to women's garments and, more particularly, to women's tops having integral brassieres.

BACKGROUND OF THE INVENTION

It is known to wear camisoles, halters, tank tops and the like as informal wear and as components of business wear. One drawback to such garments is that they typically must be worn over brassieres, both for purposes of modesty and decorum, and to provide support and comfort to the wearer. In light of this necessity, it has been proposed to combine such garments with integral brassieres.

Cordova U.S. Pat. No. 4,440,174 proposes a woman's tank top including an outer shell and an independently supported shelf bra. An elastic band is further provided about the lower edges of the shelf bra in order to draw it about the wearer. The front portion of the shelf bra is shirred to define two pockets to permit the front portion of the bra to conform to the wearer's breasts.

Friedman U.S. Pat. No. 4,564,015 proposes a ladies' top garment including an outer garment and an inner member. The inner member is attached to the outer element at the front thereof and along the arc of the upper front bound seam of the garment, generally corresponding to the garment's neckline. The inner member also is provided with encircling fabric material to be attached by means of a clasp at the rear of the garment, within the outer garment. This provides a controllable closure for the inner member and confirms the support function being furnished by extended side panels of the inner member.

Scott U.S. Pat. No. 4,798,557 proposes a camisole underwire bra garment including a camisole unit and an underwire bra unit whose upper portions share the same general contour and configuration, wherein the underwire bra unit is only connected to the camisole unit along their respective upper portions to produce a camisole garment that provides lift and support for a woman's breasts.

Green U.S. Pat. No. 5,946,726 proposes a woman's sport top with bust support including two interior bust support sections fashioned to opposite sides of an outer fabric and detachably connected together. In one embodiment, the bust support includes fabric sections containing underwire supports attached to the fabric sections for additional bust support.

One drawback to existing women's garments with integral brassieres is that they tend to be unduly complicated. A specific drawback of the garments proposed in the foregoing references is that each includes one or more detachable fasteners which must be closed when the wearer dresses. Some of these fasteners are located along the wearer's back or under the garment body where the wearer would have difficulty reaching them. Many of these fasteners are also visible from the outside of the garment, detracting from the overall appearances of the garments.

Another drawback to the existing women's garments with integral brassieres is that they tend to be uncomfortable or to fail to provide natural-looking contouring. There remains a need in the art for comfortable women's garments providing for easy, one-step dressing with smooth results.

SUMMARY OF THE INVENTION

These needs and others are addressed by a woman's garment including a tubular garment body and an inner support unit. The preferred inner support unit comprises a tubular liner secured to the garment body along an upper edge portion of the garment body; a pair of underwires secured to the liner proximate a lower edge portion of the liner; and an elastic member extending along the lower edge portion of the liner. The preferred liner is free of detachable fasteners so as to simplify the garment. In particular, the absence of bulky fasteners reduces unsightly bulges on the outside of the garment.

An especially preferred embodiment of the invention includes a camisole comprising a tubular garment body formed of a lightweight stretch material; a liner formed of a stretch mesh material secured along substantially an entire upper edge portion of the garment body; a binding secured to the upper edge portion of the garment body so as to define at least portions of a pair of adjustable straps for suspending the garment body about a wearer's torso; a pair of U-shaped underwire members secured to the liner; a pair of connectors secured to said liner to provide load-bearing connections between said U-shaped underwire members and said binding; and an elastic band secured to the pair of U-shaped underwire members and the lower edge portion of said liner. The liner most preferably includes a bridge segment between said U-shaped underwire members having a rigidity greater than a rigidity of liner material surrounding the bridge segment to help position the U-shaped underwire members so as to properly support and contour the wearer's breasts. In addition, the liner preferably includes darts formed in support sections of the liner defined by the U-shaped underwire members so as to provide natural shaping and a slight degree of concavity to the support sections and increase the surface area over which the weight of each breast is distributed. Most preferably, the liner and the elastic band are capable of encircling the wearer's torso to provide a comfortable fit and support without requiring the wearer to close detachable fasteners while dressing.

Although the following detailed description will relate primarily to camisoles, those of ordinary skill in the art will recognize that the invention is equally applicable to other types of women's garments. In particular, those of ordinary skill in the art will recognize that it is possible to embody the invention both in other types of sleeveless garments, such as halters and tank tops, and in garments having sleeves coupled to, or formed integrally with, tubular garment bodies. Accordingly, it is an object of the invention to provide a woman's garment with an integral brassiere providing style, comfort and ease of dressing. The invention will be further described in conjunction with the appended drawings and following detailed description.

DETAILED DESCRIPTION OF THE PREFERRED EMBODIMENT

Figure 1:
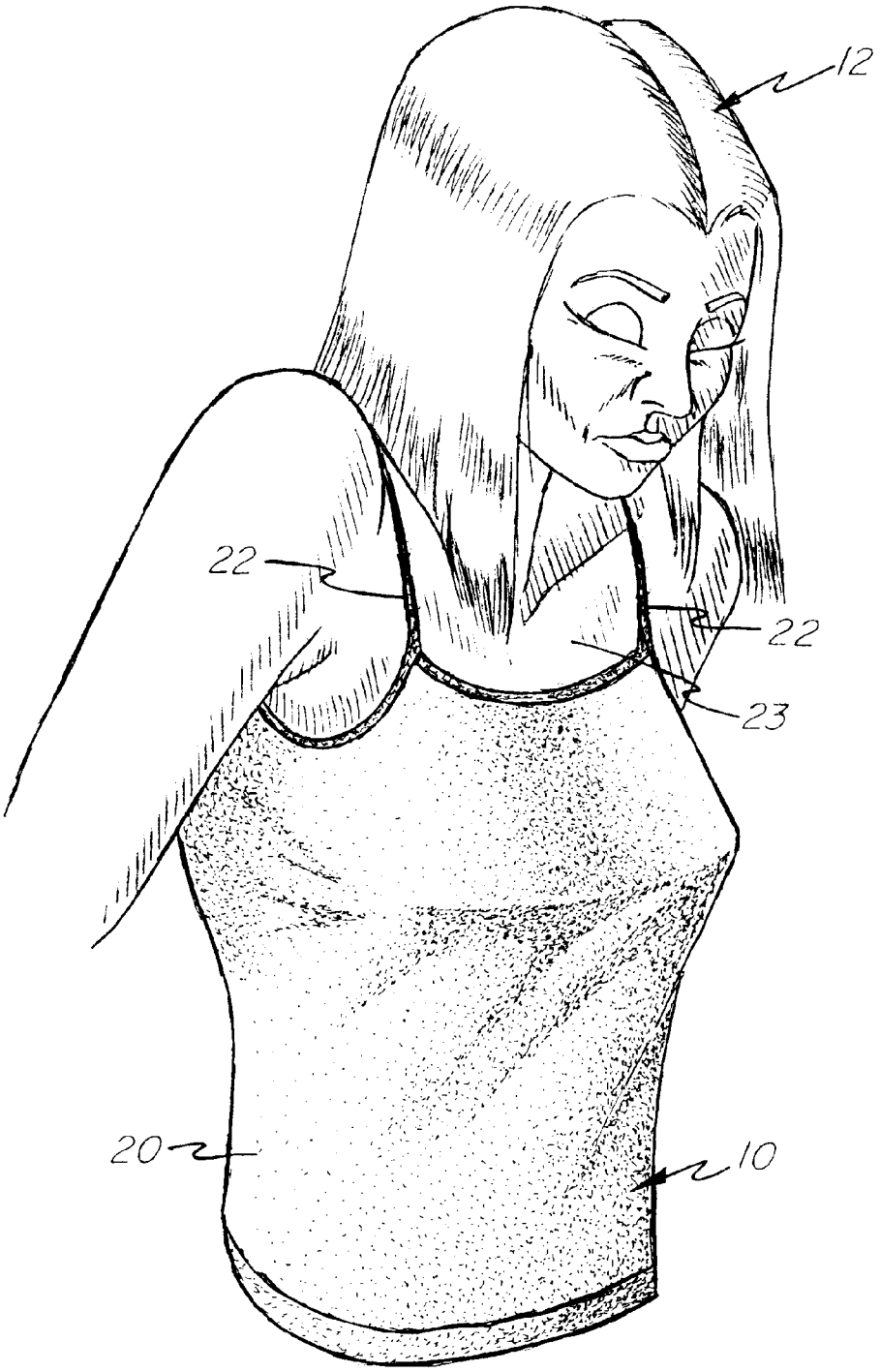
FIG. 1 is a perspective view showing a camisole in accordance with the present invention.

FIG. 1 shows a preferred embodiment of the invention, in the form of a top or camisole 10, modeled by a wearer 12.

The camisole 10 includes a tubular garment body or outer unit 20 and a pair of adjustable straps 22 for suspending the garment body 20 about a torso 23 of the wearer 12.

Figure 2:
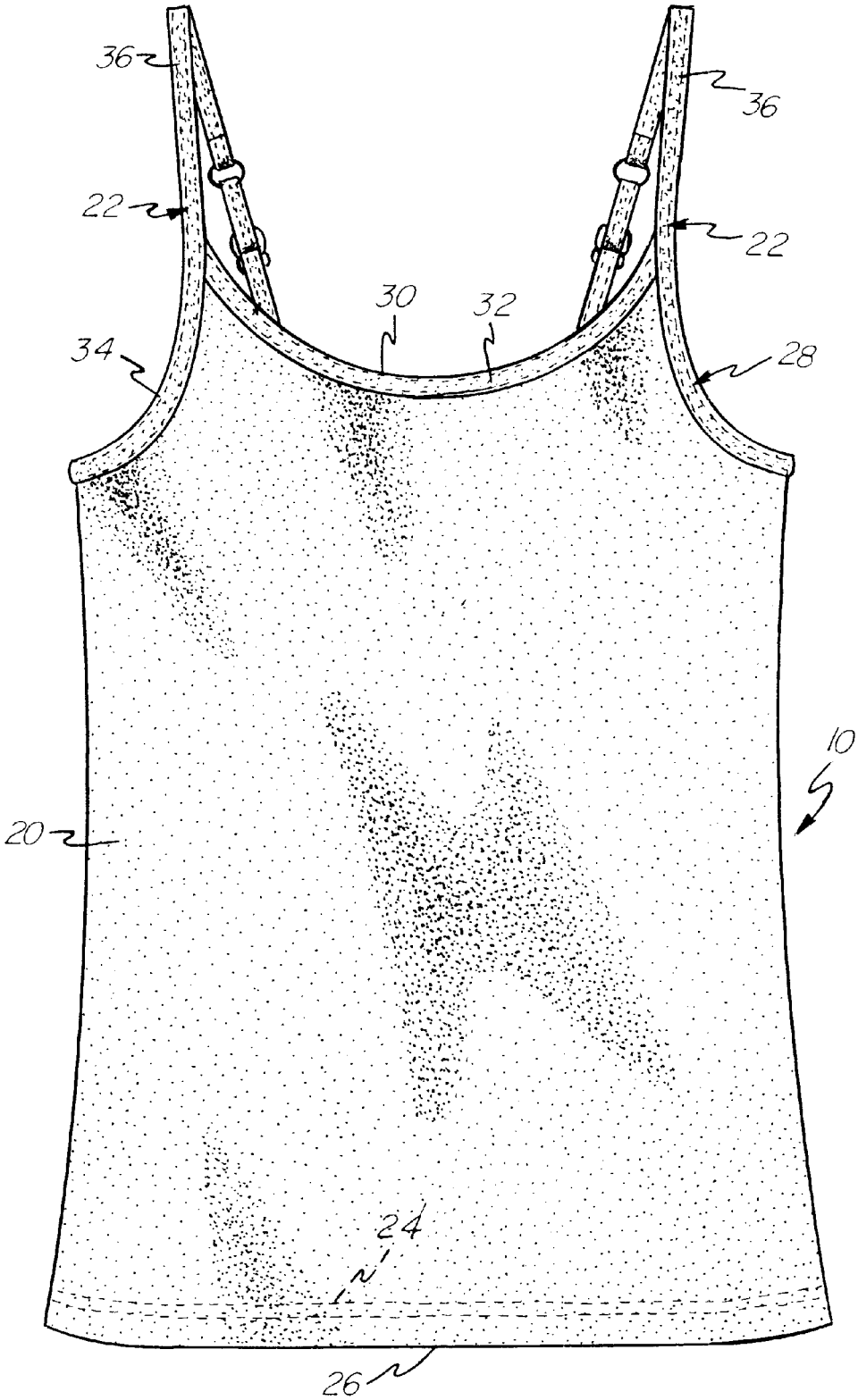
FIG. 2 is a front plan view of the camisole of FIG. 1.

As shown in FIG. 2, the preferred garment body 20 of the camisole 10 is formed from a lightweight stretch knit material, most preferably a blend including 10% SPANDEX material. The preferred garment body 20 includes a lower hem 24 proximate a lower edge portion 26 of the garment body 20 and side seams (not shown). A binding 28 is secured to the garment body 20 along an upper edge portion 30 of the garment body 20.

Figure 3:
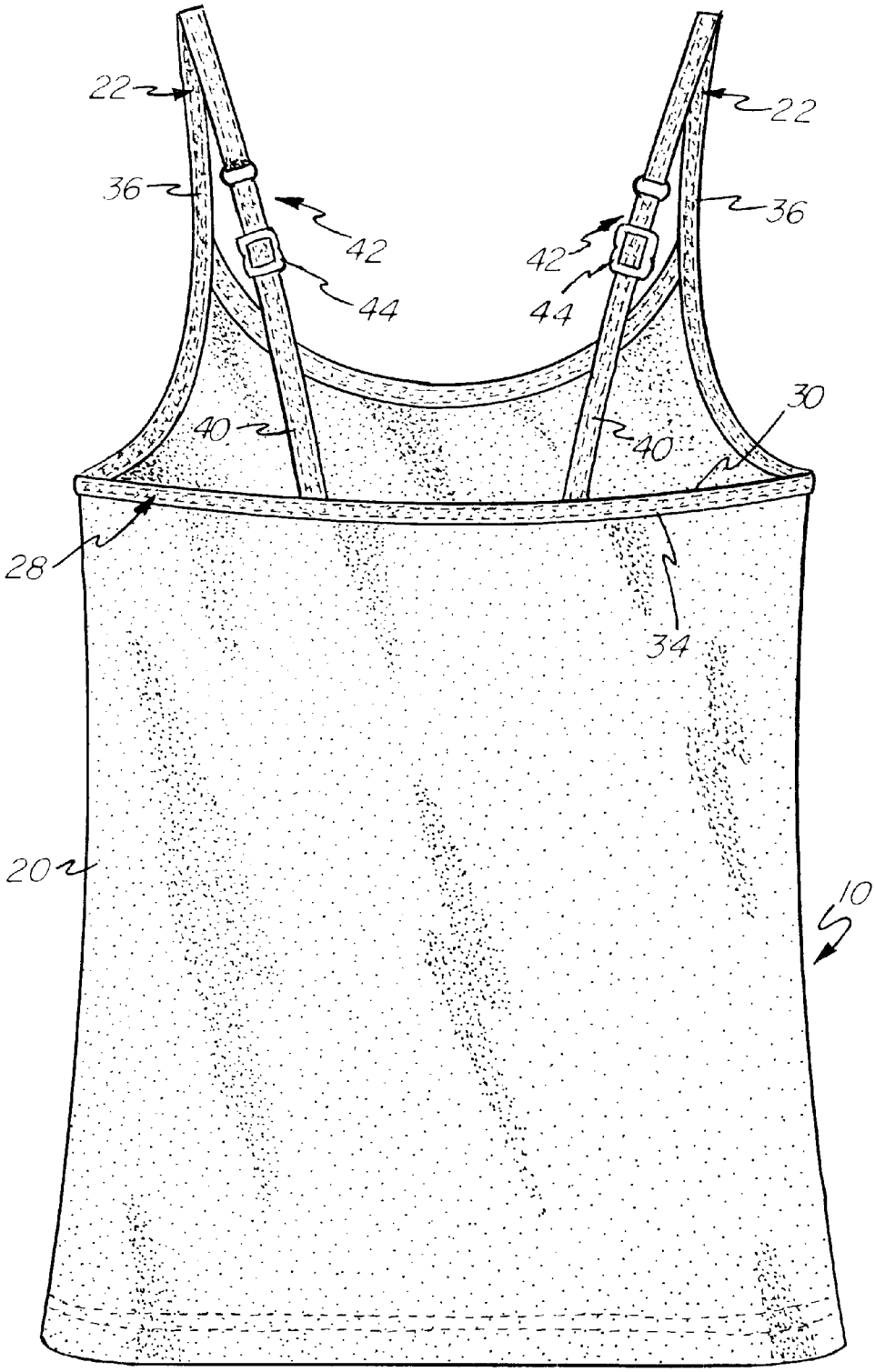
FIG. 3 is a back plan view of the camisole of FIG. 1.

The preferred binding 28 is formed in two parts, a front portion 32 and a back portion 34 having extensions 36 extending from the upper edge portion 30 to form components of the adjustable straps 22. Most preferably, the front and back portions 32, 34 each comprise fabric material folded and stitched over the upper edge portion 30 of the garment body 20. As shown in FIG. 3, the back portion 34 of the binding 28 extends continuously about a back of the wearer 12 (FIG. 1) such that the garment body 20 is free of detachable fasteners (not shown) proximate to the upper edge portion 30 and thereby free of bulges (not shown) which such detachable fasteners (not shown) would create. The binding 28 provides strength and rigidity as well as serving to improve the distribution of the load borne by the adjustable straps 22 along the upper edge portion 30 of the garment body 20.

With continuing reference to FIG. 3, the adjustable straps 22 further include rear strap segments 40 and adjustable couplers 42 for coupling the extensions 36 of the back portion 34 of the binding 28 to the rear strap segments 40. End portions of the rear strap segments 40 are secured, as by stitching, to the back portion 34 of the binding 28. Preferred adjustable couplers include adjustment slides 44 frictionally engaging free end portions of the rear strap segments 40. The configurations of the adjustable straps 22 and of the adjustable couplers 42 are not critical to the invention and alternative configurations will be apparent to those of ordinary skill in the art.

Figure 4:
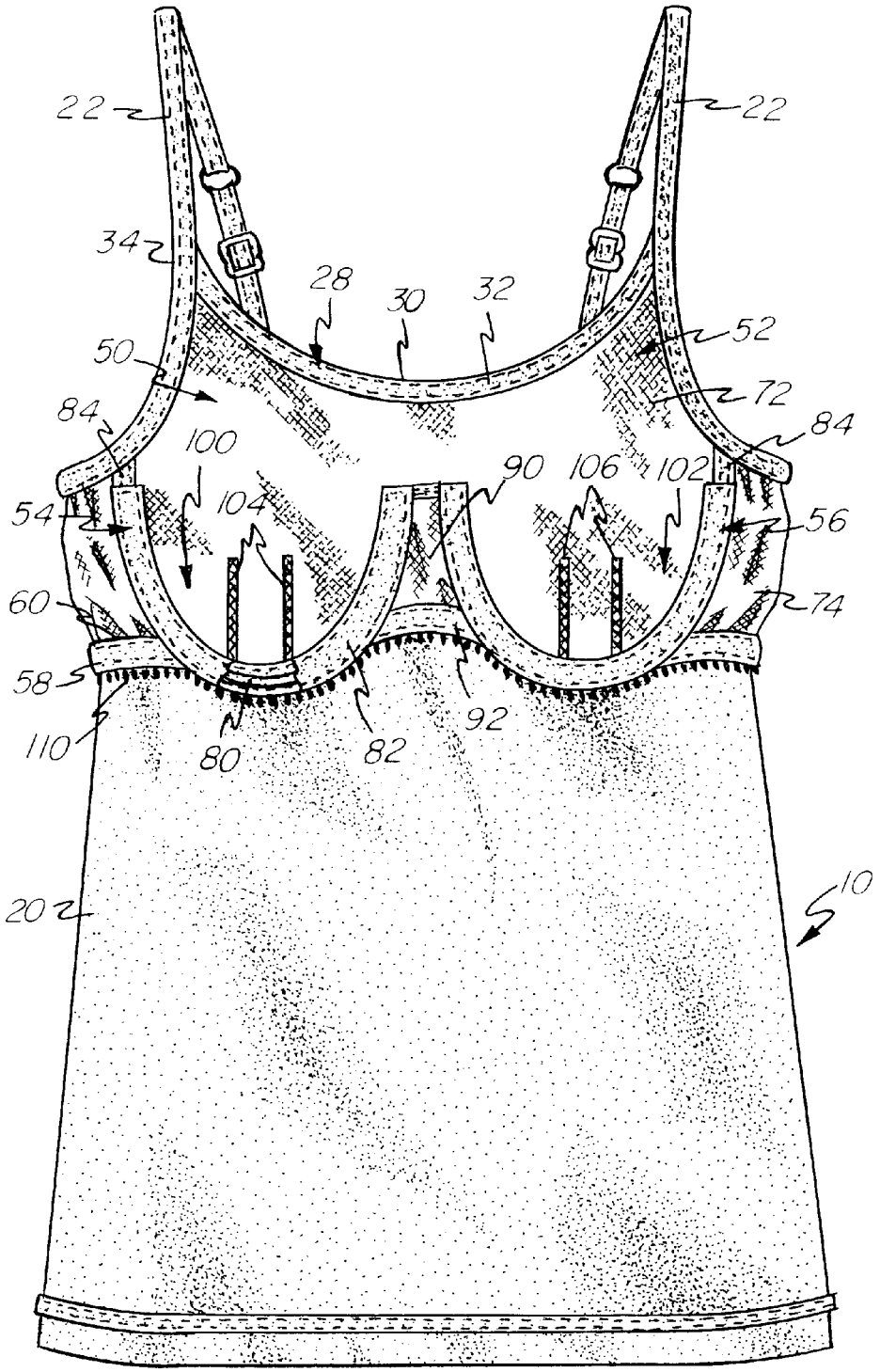
FIG. 4 is a front plan view showing the camisole of FIG. 1 turned inside-out, partially broken away to show the structure of an underwire member.

FIG. 4 is a front plan view of the preferred camisole 10 turned inside-out to show the construction of an inner support unit 50 forming an integral brassiere within the garment body 20. The preferred inner support unit 50 includes a tubular liner 52; a pair of U-shaped underwire members 54 and 56; and an elastic member 58 extending along a lower edge portion 60 of the liner 52.

Figure 5:
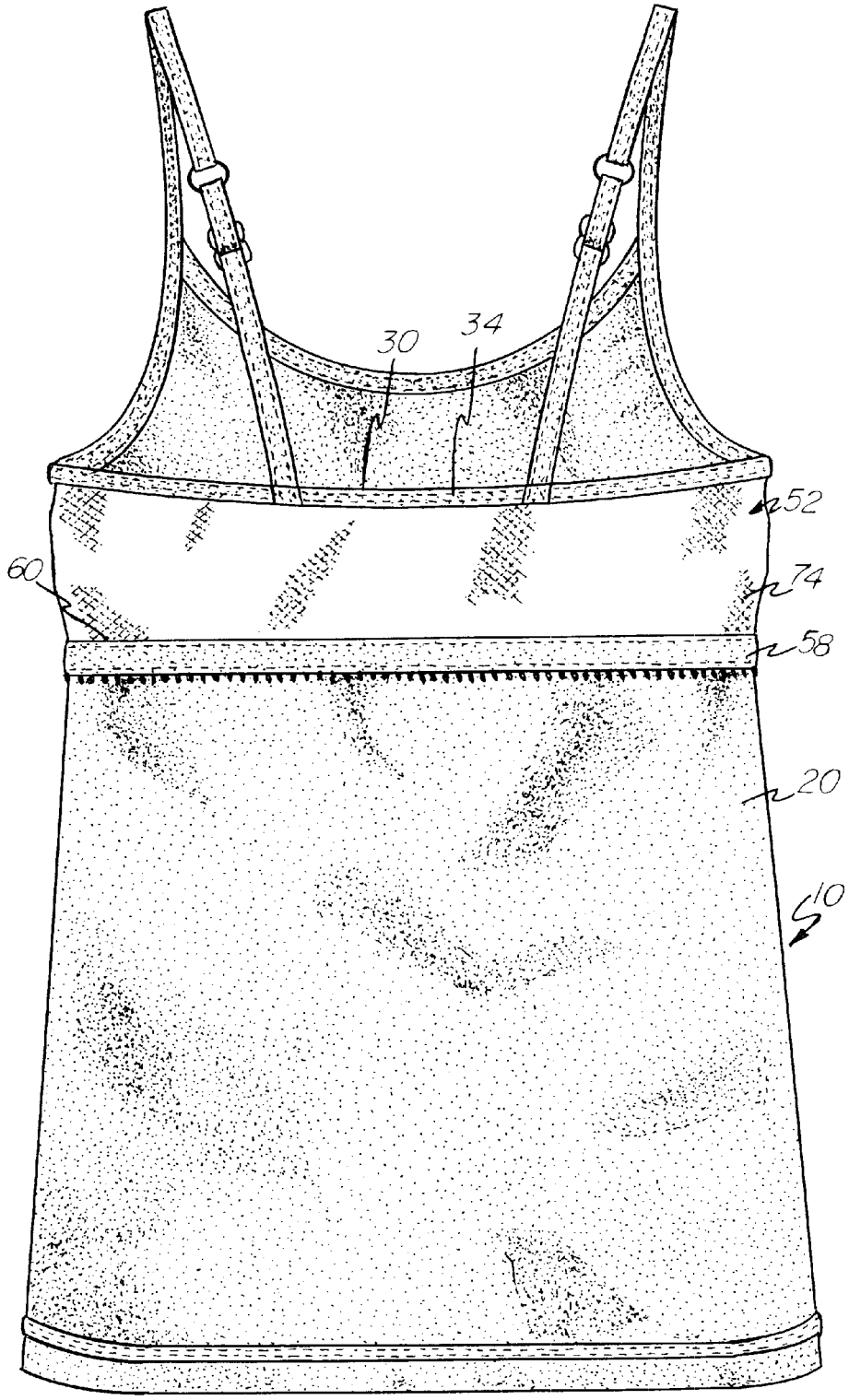
FIG. 5 is a back plan view showing the camisole of FIG. 1 turned inside-out.

As shown in FIGS. 4 and 5, the preferred tubular liner 52 comprises a front component 72 and a back component 74 which together are capable of encircling the torso 23 (FIG. 1) of the wearer 12 (FIG. 1). The liner 52 is secured along the upper edge portion 30 of the garment body 20. Most preferably, the front and back sections 32, 34 of the binding 28 are folded and stitched over both the upper edge portion 30 of the garment body 20 and the adjoining portion of the liner 52 so as to secure the liner 52 along the upper edge portion 30. The preferred liner 52 is free of detachable fasteners (not shown), so as to simplify the camisole 10 and to avoid bulges (not shown) which such detachable fasteners (not shown) might otherwise create.

The liner 52 is preferably formed from a lightweight, stretchable, strong mesh material which permits air to flow through the liner to the torso 23 (FIG. 1) of the wearer 12 (FIG. 1) and moisture to evolve therethrough. The material from which the liner 52 is formed has a degree of stretch so as to conform comfortably to the shape of the torso 23 (FIG. 1) and movement of the wearer.

Returning exclusively to FIG. 4, the preferred underwire members 54, 56 each comprise a U-shaped, rigid metallic or polymeric underwire 80 encapsulated in soft fabric material or the like 82 to provide support for, and contouring of, the breasts (not shown) of the wearer 12 (FIG. 1). The fabric material or the like 82 is preferably secured, as by stitching, to the front component 72 of the liner 52. Most preferably, connectors in the form of connective strips 84 comprising relatively rigid fabric material or the like secured to the liner 52, as by stitching. The connective strips 84 provide load-bearing connections between the underwire members 54 and the binding 28 so as to transfer the weight the breasts (not shown) of the wearer 12 (FIG. 1) from the underwire members 54, 56 to the adjustable straps 22 and the shoulders of the wearer 12.

A bridge segment 90 extends between the underwire members 54, 56 to stabilize the positioning of the breasts (not shown) of the wearer 12 (FIG. 1) and to provide additional support therefor. The bridge 90 most preferably comprises a rigid fabric (not shown) sandwiched inside two or more layers of the mesh material from which the liner 52 is formed, joined by a seam or the like, thereby providing greater rigidity than that of the surrounding liner material so as to stabilize the spacing of the underwire members 54, 56.

The underwire members 54, 56 each define support sections 100 and 102 of the front component 72 of the liner 52. These support sections 100, 102 each include pairs of darts 104 and 106, which provide a slight degree of concavity to the support sections 100, 102. The darts 104, 106 serve to increase the comfort of the wearer 12 (FIG. 1) and to improve the support of the wearer's breasts (not shown) by shaping the surface area under each breast over which the weight of each breast is distributed. The darts 104, 106 also cooperate with the underwire members 54, 56 to firm and contour the breasts so as to provide a desirable, youthful appearance.

The elastic member 58 takes the form of an elastic band secured, as by stitching, to the underwire members 54, 56; the bridge segment 90; and the liner 52 along the lower edge portion 60 of the liner 52. The elastic member 58 serves to position the underwire members 54, 56 and the support sections 100, 102 relative to the torso 23 (FIG. 1) of the wearer 12 (FIG. 1) so as to promote the support for, and contouring of, the breasts (not shown) of the wearer 12. Most preferably, the elastic members 58 conforms to the curvature of the underwire members 54, 56 so as to relieve pinching of the torso 23 (FIG. 1) and to decrease the risk that the profiles of the underwire members 54, 56 or the elastic member 58 will show through the garment body 20.

The preferred elastic member 58 includes a fringe 110 inherent to the material from which the preferred elastic member is made. Those skilled in the art will recognize that such a fringe is not critical to the present invention. Those skilled in the art will further recognize that various decorative flares (not shown) may be added to the camisole 10 or to its various components without departing from the scope of the invention.

From the foregoing description, those skilled in the art will appreciate present invention is directed toward a versatile garment construction providing comfortable support for, as well as natural-looking contouring of, the wearer's breasts. The preferred garment is free of detachable fasteners, thereby permitting easy, one-step dressing. While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In woman's garment including a tubular garment body and an inner support unit, said garment body defining an upper edge portion, the improvement wherein said inner support unit comprises a tubular liner secured to said garment body along said upper edge portion, said liner being free of detachable fasteners and defining a lower edge portion; a pair of underwires secured to said liner proximate said lower edge portion; and an elastic member extending along said lower edge portion of said liner.

2. The improvement as recited in claim 1 including at least one strap extending from said garment body for suspending said garment body about a torso of a wearer.

3. The improvement as recited in claim 1 including at least one strap extending from said garment body for suspending said garment body about a torso of a wearer and at least one connector secured to said liner to provide a load-bearing connections between at least one of said underwires and said at least one strap.

4. The improvement as recited in claim 1 wherein said liner is secured to said garment body along substantially an entirety of said upper edge portion.

5. The improvement as recited in claim 1 wherein said liner comprises a stretch mesh material.

6. The improvement as recited in claim 1 wherein said liner defines a bridge segment between said underwires having a rigidity greater than a rigidity of liner material surrounding the bridge segment.

7. The improvement as recited in claim 1 wherein said underwires each define support sections of said liner and wherein said support sections each include at least one dart.

8. The improvement as recited in claim 1 wherein said elastic member is an elastic band secured to said underwires and along said lower edge of said liner.

9. A woman's garment comprising:

a tubular garment body including an upper edge portion and at least one strap for suspension of said garment body about a wearer's torso; and an inner support unit including a liner free of detachable fasteners, said liner being secured to said upper edge portion and being capable of encircling the wearer, said liner defining a lower edge portion; an elastic member secured said lower edge portion; and a pair of U-shaped underwire members attached to said liner so that said U-shaped underwire members and said elastic member cooperate to firmly support and contour the wearer's breasts.

10. The woman's garment as recited in claim 9, wherein said garment body comprises a lightweight stretch fabric.

11. The woman's garment as recited in claim 9 wherein said garment body includes 10% SPANDEX material.

12. The woman's garment as recited in claim 9 wherein including a binding secured to said upper edge portion, said binding capable of support by said at least one strap.

13. The woman's garment as recited in claim 9 wherein said liner comprises a stretch mesh material.

14. The woman's garment as recited in claim 9 wherein including a binding secured to said upper edge portion, said binding capable of support by said at least one strap; and at least one connector connecting at least one of said U-shaped underwire members with said binding, said connector having a rigidity greater than a rigidity of said liner.

15. The improvement as recited in claim 9 wherein said liner defines a bridge segment between said U-shaped underwire members having a rigidity greater than a rigidity of liner material surrounding the bridge segment.

16. The improvement as recited in claim 9 wherein said U-shaped underwire members each define support sections of said liner and wherein said support sections each include at least one dart.

17. The improvement as recited in claim 1 wherein said elastic member is an elastic band secured to said U-shaped underwire members and along said lower edge of said liner.

18. In woman's garment including a tubular garment body and an inner support unit, said garment body defining an upper edge portion, the improvement wherein said inner support unit comprises a liner secured to said garment body along said upper edge portion, said liner being capable of encircling a torso of a wearer and free of detachable fasteners, said liner defining a lower edge portion; a pair of underwires secured to said liner proximate said lower edge portion, said underwires defining support sections of said liner; darts formed in said support sections providing concavity to the support sections; and an elastic member capable of encircling the wearer's torso secured to said underwires and along said lower edge portion of said liner.

19. The woman's garment as recited in claim 18 including at least one strap for suspending said garment body about the wearer's torso and at least one connector secured to said liner to provide a load-bearing connection between at least one of said underwires and said at least one strap.

20. The improvement as recited in claim 18 wherein said liner comprises a stretch mesh material.

21. The improvement as recited in claim 18 wherein said liner defines a bridge segment between said underwires having a rigidity greater than a rigidity of liner material surrounding the bridge segment.

22. A camisole comprising:

a tubular garment body formed of a lightweight stretch material and defining an upper edge portion;

a liner formed of a mesh material secured along substantially an entirety of said upper edge portion, said liner being capable of encircling the wearer's torso, said liner defining a lower edge portion;

a binding secured to said upper edge portion of said garment body, said binding defining at least portions of a pair of adjustable straps for suspending said garment body about a wearer's torso;

a pair of U-shaped underwire members secured to said liner, said U-shaped underwire members each defining a support section of said;

at least one dart in each of said support sections;

a pair of connectors secured to said liner to provide load-bearing connections between said U-shaped underwire members and said binding;

said liner defining a bridge segment between said U-shaped underwire members having a rigidity greater than a rigidity of liner material surrounding the bridge segment; and an elastic band capable of encircling the wearer's torso, said elastic band being secured to said pair of U-shaped underwire members and said lower edge portion of said liner, said garment body and liner being free of detachable fasteners.

* * * * *